US008367883B2

(12) United States Patent
Tanaka

(10) Patent No.: US 8,367,883 B2
(45) Date of Patent: Feb. 5, 2013

(54) SYNTHETIC NAPHTHA MANUFACTURING METHOD

(75) Inventor: Yuichi Tanaka, Yokohama (JP)

(73) Assignees: Japan Oil, Gas and Metals National Corporation, Kanagawa (JP); Inpex Corporation, Tokyo (JP); Nippon Oil Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 437 days.

(21) Appl. No.: 12/733,859

(22) PCT Filed: Sep. 25, 2008

(86) PCT No.: PCT/JP2008/067308

§ 371 (c)(1),
(2), (4) Date: May 5, 2010

(87) PCT Pub. No.: WO2009/041508

PCT Pub. Date: Apr. 2, 2009

(65) Prior Publication Data

US 2010/0217055 A1 Aug. 26, 2010

(30) Foreign Application Priority Data

Sep. 28, 2007 (JP) ..... 2007-256547
Sep. 28, 2007 (JP) ..... 2007-256548

(51) Int. Cl.
*C07C 1/20* (2006.01)

(52) U.S. Cl. ..... 585/315; 585/250; 585/254; 585/310; 518/726; 208/142; 208/143; 208/144; 208/145

(58) Field of Classification Search ..... 518/726; 585/250, 254, 310, 315; 208/142–145
See application file for complete search history.

(56) References Cited

U.S. PATENT DOCUMENTS 5,660,714 A 8/1997 Wittenbrink et al.
6,635,681 B2 * 10/2003 Moore, Jr. et al. ..... 518/700
(Continued)

FOREIGN PATENT DOCUMENTS

JP 11-509137 8/1999
JP 2002-506473 2/2002
(Continued)

OTHER PUBLICATIONS

International Search Report dated Dec. 16, 2008 issued in corresponding PCT Application No. PCT/JP2008/067308.

(Continued)

*Primary Examiner* — Brian McCaig
(74) *Attorney, Agent, or Firm* — Kenyon & Kenyon LLP

(57) ABSTRACT

The present invention relates to a method of manufacturing naphtha, wherein, in hydrogenation of a naphtha fraction which is fractionated from synthetic oil (FT synthetic oil) obtained by Fisher-Tropsch synthesis, the hydrogenised component is recycled and the recycled amount thereof is adjusted to reduce a olefin content in a hydro-refining apparatus whereby heat generation is suppressed and unstable operation of the hydro-refining apparatus can be stabilized. Furthermore, the present invention relates to a method of manufacturing naphtha, wherein a cut point for fractionating a naphtha fraction from FT synthetic oil is adjusted to reduce the amount of olefin in a hydro-refining apparatus whereby unstable operation of the hydro-refining apparatus can be stabilized.

6 Claims, 1 Drawing Sheet

U.S. PATENT DOCUMENTS

| | | | | |
|---|---|---|---|---|
| 2003/0141220 | A1* | 7/2003 | O'Rear et al. | 208/79 |
| 2003/0153634 | A1 | 8/2003 | Rainis et al. | |
| 2005/0004414 | A1 | 1/2005 | Mayer et al. | |

FOREIGN PATENT DOCUMENTS

| | | |
|---|---|---|
| JP | 2004-323626 | 11/2004 |
| JP | 2005-514516 | 5/2005 |
| JP | 2007-527450 | 9/2007 |
| WO | WO 98/59019 | 12/1998 |
| WO | WO 2007/034555 | 3/2007 |

OTHER PUBLICATIONS

Japanese Office Action dated Sep. 18, 2012 issued in corresponding Japanese Application No. 2009-534363 [with English Translation].

* cited by examiner

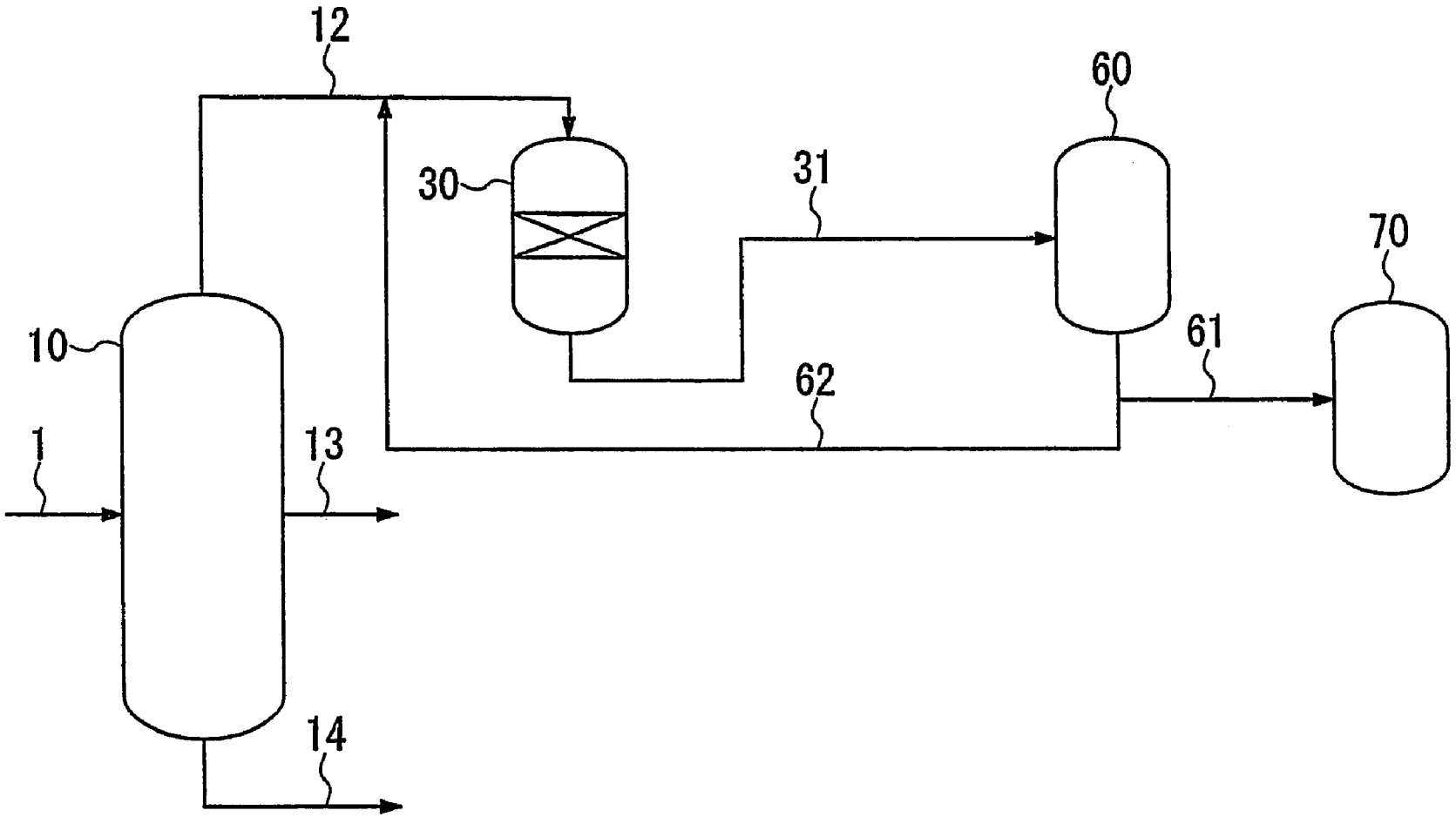
70
61
60
31
62
30
12
13
14
10
1

SYNTHETIC NAPHTHA MANUFACTURING METHOD

This application is a national stage application of International Application No. PCT/JP2008/067308, filed 25 Sep. 2008, which claims priority to Japanese Application Nos. 2007-256547, filed 28 Sep. 2007; and 2007-256548, filed 28 Sep. 2007, each of which is incorporated by reference in its entirety.

TECHNICAL FIELD

The present invention relates to a method of manufacturing synthetic naphtha from synthetic oil obtained by a Fisher-Tropsch synthesis method.

BACKGROUND ART

In recent years, from the standpoint of reduction of environmental burdens, there has been a need for a clean liquid fuel which has a low content of sulfur and aromatic hydrocarbons and is compatible with the environment. Thus, in the petroleum industry, a Fisher-Tropsch synthesis method (hereinafter abbreviated as "FT synthesis method) using carbon monoxide and hydrogen as raw materials has been investigated as a method of manufacturing a clean fuel. The FT synthesis method has high expectations since it can manufacture a liquid fuel base stock which has an abundance of paraffin and which does not contain sulfur, for example, a diesel fuel base stock. For example, Patent Document 1 discloses a fuel oil compatible with the environment.

Patent Document 1: Japanese Unexamined Patent Application, Publication No. 2004-323626

A synthetic oil obtained by the FT synthesis method (hereinafter may be referred to as "FT synthetic oil") has a broad carbon number distribution. From the FT synthetic oil, it is possible to obtain, for example, an FT naphtha fraction containing a number of hydrocarbons having a boiling point of less than 150° C., an FT middle fraction containing a number of hydrocarbons having a boiling point of 150° C. to 360° C.; and an FT wax fraction heavier than the FT middle fraction.

DISCLOSURE OF THE INVENTION

Problem that the Invention is to Solve

In the prior art, the FT naphtha fraction contains a great quantity of olefins in addition to alcohols. Therefore, it is required for the FT naphtha fraction to be hydrogenated and converted into a saturated compound that can be utilized in the same manner as naphtha distilled from crude oil.

Therefore, such alcohols or olefins is to be hydrogenated by a hydro-refining apparatus. However, since addition of hydrogen to olefins causes an exothermic reaction, a great deal of heat is generated. Since such heat generation is excessive, the flow rate or a change in the olefin content in the process leads to variations in the heat generation rate which likely cause the operation of the hydro-refining apparatus to be unstable.

Means for Solving the Problem

Based on the above-described grounds, the first object of the invention is to stabilize the operation of such a hydro-refining apparatus, which are unfavorably unstable in the prior art, by way of the following procedures. That is, in hydrogenation of the naphtha fraction, a hydrogenated component is recycled, and the amount of the recycled product is adjusted to suppress heat generation in the hydro-refining apparatus, thereby making operation of the hydro-refining apparatus stable.

Furthermore, the second object of the invention is to stabilize the operation of such a hydro-refining apparatus, which are unfavorably unstable in the prior art, by way of the following procedures. That is, considering that the heavier FT synthetic oil is, the less olefins are present in the FT synthetic oil, a cut point for fractionating the naphtha fraction is adjusted to suppress heat generation in the hydro-refining apparatus, thereby making operation of the hydro-refining apparatus stable.

Specifically, the first aspect of the present invention relates to the following.

(1) A method of manufacturing naphtha, including: fractionating synthetic oil, which is obtained by Fisher-Tropsch synthesis, in a fractionator to separate the synthetic oil into a naphtha fraction as raw naphtha containing 10% by mass or more of an olefin and 5% by mass or more of an alcohol, and at least one fraction containing a hydrocarbon heavier than the naphtha fraction; and hydrogenating the naphtha fraction by bringing the naphtha fraction into contact with a hydrogenating catalyst in a hydro-refining apparatus to remove the alcohol and the olefin, thereby producing a hydrogenated naphtha fraction containing substantially only a paraffin component, wherein 20% to 80% by volume of the produced hydrogenated naphtha fraction with respect to the raw naphtha is mixed into the raw naphtha to hydrogenate the naphtha fraction whereby heat generation due to hydrogenation of the olefin and hydrogenation of the alcohol is suppressed.

(2) The method of manufacturing naphtha according to (1), wherein the amounts of the olefin and the alcohol contained in the raw naphtha are measured in advance; and the ratio of the produced hydrogenated naphtha fraction mixed into the raw naphtha is adjusted where an olefin content in a mixed feed corresponding to the sum of the raw naphtha and the recycled hydrogenated naphtha fraction that are introduced into the hydro-refining apparatus is diluted to a concentration of 10% by mass or less, and an alcohol content in the mixed feed is diluted to a concentration of 5% by mass or less.

(3) The method of manufacturing naphtha according to (1) or (2), further including adjusting a cut point in the fractionator to reduce the amounts of the olefin and the alcohol contained in the naphtha fraction whereby heat generation due to hydrogenation of the olefin and hydrogenation of the alcohol is suppressed in hydrogenating the naphtha fraction by bringing the naphtha fraction into contact with the hydrogenating catalyst in the hydro-refining apparatus to remove the alcohol and the olefin, thereby producing the hydrogenated naphtha fraction containing substantially only a paraffin component.

(4) The method of manufacturing naphtha according to any one of (1) to (3), wherein the cut point is adjusted where the amount of the olefin contained in the naphtha fraction reaches 11% by mass or less and the amount of the alcohol contained in the naphtha fraction reaches 6% by mass or less.

Furthermore, the second aspect of the present invention relates to the following.

(5) A method of manufacturing naphtha, including: fractionating synthetic oil, which is obtained by Fisher-Tropsch synthesis, in a fractionator to separate the synthetic oil into a naphtha fraction and at least one fraction containing a hydrocarbon heavier than the naphtha fraction; and hydrogenating the naphtha fraction by bringing the naphtha fraction into contact with a hydrogenating catalyst in a hydro-refining apparatus to convert an alcohol and an olefin into a paraffin component, thereby producing a hydrogenated naphtha fraction containing substantially only the paraffin component, wherein the amounts of the olefin and the alcohol contained in the naphtha fraction are reduced by adjusting a cut point in the fractionator to suppress heat generation due to hydrogenation of the olefin and hydrogenation of the alcohol.

(6) The method of manufacturing naphtha according to (5), wherein the cut point is adjusted where the amount of the olefin contained in the naphtha fraction reaches 11% by mass or less, and the amount of the alcohol contained in the naphtha fraction reaches 6% by mass or less.

Advantage of the Invention

According to the present invention, in hydrogenation of the naphtha fraction separated from the FT synthetic oil, the hydrogenated component is recycled, and the amount of the recycled product is adjusted to suppress the heat generation in the hydro-refining apparatus, thereby making the operation of the hydro-refining apparatus stable.

Furthermore, according to the present invention, the cut point for fractionating the FT synthetic oil into the naphtha fraction is adjusted to suppress heat generation in the hydro-refining apparatus, thereby making the operation of the hydro-refining apparatus stable.

BRIEF DESCRIPTION OF THE DRAWINGS

FIG. 1 is a schematic diagram showing a plant for manufacturing a diesel fuel base stock according to one embodiment of the present invention. The production plant includes a fractionator 10 wherein FT synthetic oil is fractionated; and a hydrogenating apparatus 30 wherein a naphtha fraction among a naphtha fraction, a middle fraction and a wax fraction which are fractionated in the fractionator 10 is hydrogenated.

DESCRIPTION OF REFERENCE NUMERALS

10: FRACTIONATOR TO FRACTIONATE THE FT SYNTHETIC OIL

30: HYDRO-REFINING APPARATUS OF NAPHTHA FRACTION THAT IS FRACTIONATED IN THE FRACTIONATOR 10

60: STABILIZER THAT EXTRACTS LIGHT GAS

70: NAPHTHA STORAGE TANK

BEST MODE FOR CARRYING OUT THE INVENTION

Hereinafter, a plant used for a diesel fuel base stock manufacturing method according to a preferred embodiment of the invention will be described with reference to FIG. 1.

As shown in FIG. 1, the plant for manufacturing a fuel base stock includes a fractionator 10 wherein FT synthetic oil is fractionated. In the fractionator 10, the FT synthetic oil is fractionated into a naphtha fraction, a middle fraction and a wax fraction. Then, the naphtha fraction is treated in a hydro-refining apparatus 30.

The naphtha fraction supplied from the hydro-refining apparatus 30 passes through a stabilizer 60 and a line 61, and stored in a naphtha storage tank 70 as naphtha. A predetermined ratio of a bottom fraction in the stabilizer 60 was sent back to a line 12 prior to the hydro-refining apparatus 30 through a line 62, thereby recycling the bottom fraction.

In the first fractionator 10, the FT synthetic oil may be fractionated into three fractions which can be divided by boiling points of 160° C. and 360° C., such as a naphtha fraction, a middle fraction (kerosene and gas oil fraction), and a wax fraction. The fractionator 10 is connected with a line 1 for introducing the FT synthetic oil into the plant; and lines 12, 13 and 14 for conveying fractionated distillates (fractions). More specifically, the lines 12, 13 and 14 are lines for conveying the naphtha fraction, which can be fractionated under a temperature condition of less than 160° C.; the middle fraction which can be fractionated under a temperature condition of 160° C. to 350° C.; and the wax fraction which can be fractionated under a temperature condition of more than 350° C., respectively. The above-described cut point for each fraction is an example. Therefore, when the FT synthetic oil is fractionated, a cut point for each fraction can be appropriately selected in terms of yield of targeted final products, etc. In particular, it is preferable that the first cut point be set to 150 to 190° C.

(Fractionation of FT Synthetic Oil)

FT synthetic oil provided for the present invention is not particularly limited as long as it is produced by a FT synthesis method. However, the synthetic oil preferably includes 80% by mass or more of a hydrocarbon having a boiling point of 150° C. or higher; and 35% by mass or more of a hydrocarbon having a boiling point of 360° C. or higher, based on the total amount of FT synthetic oil. The total amount of FT synthetic oil means the sum of hydrocarbons having 5 or more carbon atoms, which are produced by the FT synthesis method.

In the fractionator 10, the FT synthetic oil can be fractionated by setting at least two cut points (cut temperature) whereby a fraction of less than the first cut point is obtained as a naphtha fraction through the line 12; a fraction of the first cut point to the second cut point is obtained as a middle fraction being kerosene and gas oil fractions through the line 13; and a fraction of higher than the second cut point is obtained as tower bottom oil (heavy wax fraction) being a wax fraction through the line 14. However, the number of cut points may be suitably changed depending on the number of required fractions. For example, if it is required to fractionate only two fractions such as a naphtha fraction and a fraction heavier than the naphtha fraction in the fractionator 10, the number of cut points can be one.

In addition, the pressure inside the fractionator 10 may be adjusted to reduced pressure or normal pressure. In general, atmospheric distillation (distillation under normal pressure) may be adopted.

The naphtha fraction is sent through the line 12 to the hydro-refining apparatus 30 wherein the naphtha fraction is hydrogenated. The naphtha fraction extracted from the line 12 is so-called naphtha, which can be used as a petrochemical material.

Compared to naphtha produced from crude oil, the naphtha fraction prepared from the FT synthetic oil includes relatively much olefins and alcohols, and therefore, it is difficult to use the naphtha fraction in the same manner as general naphtha produced from crude oil. In addition, the ratio of such olefins and alcohols in the light fraction is the highest among fractions of the FT synthetic oil. Consequently, the ratio of olefins and alcohols in the naphtha fraction is the highest while the ratio thereof in the wax fraction is the lowest.

In the present description, olefins and an alcohols are measured as values (% by mass) calculated from component analysis results of the components separated therefrom and quantitated by a gas chromatograph equipped with a nonpolar column, and a FID (flame ionization detector); and using He as carrier gas, and a predetermined temperature program unless otherwise mentioned.

Based on the above-described grounds, in the hydro-refining apparatus 30, olefins are hydrogenated by a hydrogenation treatment to convert the olefins into paraffins, and alcohols are subjected to a hydrogenation treatment to remove a hydroxyl group whereby the alcohols are also converted into paraffins. In addition, as long as the treated naphtha fraction is utilized for general naphtha use, it is unnecessary to conduct isomerization to convert n-paraffin into iso-paraffin, or decomposition of n-paraffin. That is, the naphtha fraction is delivered from the hydro-refining apparatus 30 to the stabilizer 60 through the line 31, light fractions such as gas are extracted from the top of the hydro-refining apparatus 30, and the naphtha fraction obtained from the bottom of the stabilizer 60 may be simply stored in the naphtha storage tank 70 through the line 61.

In the hydro-refining apparatus 30, an unsaturated hydrogen-addition reaction generates a relatively large amount of heat, and the heat generation rate is affected by changes in flow rates in the process or the like, whereby operation of the apparatus is easily made unstable.

Therefore, it is preferable that the hydro-refining apparatus 30 be operated where the heat generation is suppressed.

In the first aspect of the present invention, in order to suppress the heat generation in the hydro-refining apparatus 30, while a portion of the product from the hydro-refining apparatus 30 is circulated to the line 12 to dilute reactants in the hydro-refining apparatus 30 with the hydro-refined product, thereby suppressing the reaction heat, it is required to adjust the amount of the recycled hydro-refined product. Furthermore, in the second aspect of the present invention, such adjustment of the amount of the recycled hydro-refined product may be combined with adjustment of a cut point for the naphtha fraction. Hereinafter, the adjustment of the amount of the recycled hydro-refined product will be described.

Specifically, when a raw material whose olefin concentration is higher is supplied to the hydro-refining apparatus 30 through the line 12, the hydro-refined product is delivered back to the line 12 prior to the hydro-refining apparatus 30 through the line 62 to recycle the hydro-refined product. In this case, if the amount of the recycled hydro-refined product is adjusted (specifically, the amount of recycled product is increased when the raw material has a large amount of olefins, or the amount of the recycled product is decreased when the raw material has less olefins in order to adjust the olefin content in the raw material), the heat generation can be suppressed whereby operation of the hydro-refining apparatus 30 can be stably carried out.

The product in the hydro-refining apparatus 30 is extracted to the line 31, and this is sent to the stabilizer 60. Then, while a gas fraction is discharged from the tower apex (not shown in the FIGURE), the naphtha fraction passes from the bottom through the line 61, and is stored in the storage tank 70. As described above, a portion of the hydro-refined naphtha fraction is delivered through the line 62 to the line 12 ahead of the hydro-refining apparatus 30 wherein the hydro-refined naphtha fraction is again hydro-refined with the naphtha fraction supplied from the fractionator 10. Since the naphtha fraction is diluted by the amount of recycled hydro-refined product, the reaction heat of hydro-refining in the apparatus 30 may be suppressed. Therefore, if the amount of the recycled product is adjusted, the concentration of olefins in the hydro-refining apparatus 30 can be lowered, thereby suppressing the heat generation.

More specifically, in the fractionator 10, the FT synthetic oil is fractionated into a naphtha fraction containing 10% by mass or more of olefins and 5% by mass or more of alcohols; and at least one fraction containing hydrocarbons heavier than the naphtha fraction, and each fraction may be introduced into supplying lines such as lines 12, 13 or 14, illustrated in the FIGURE. In FIG. 1, the FT synthetic oil is fractionated into two fractions, i.e., a middle fraction and a wax fraction, containing hydrocarbons heavier than the naphtha fraction, and the fractions are extracted to the lines 13 and 14.

The naphtha fraction is brought into contact with a hydrogenating catalyst in the hydro-refining apparatus 30 to hydrogenate the naphtha fraction whereby the alcohols and the olefins are removed and a hydrogenated naphtha fraction containing only a paraffin component is obtained through the line 31. In order to suppress the heat generation due to hydrogenation of olefins or dehydroxylation of alcohols, 20% to 80% by volume of the hydrogenated naphtha fraction is mixed into the raw naphtha in the line 12 by circulating the hydrogenated naphtha fraction from the stabilizer 60 to the line 12 via the line 62.

Furthermore, the amounts of olefins and alcohols contained in the raw naphtha fraction are measured in advance, and the amount of the hydrogenated naphtha fraction mixed into the raw naphtha may be adjusted in order to suppress the heat generation in the hydro-refining apparatus 30.

More specifically, the mixing ratio of the hydrogenated naphtha fraction may be adjusted where the olefin content in the mixed feed (corresponding to the sum of the raw naphtha and the recycled hydrogenated naphtha fraction) that is introduced into the hydro-refining apparatus 30 is diluted to a concentration of 10% by mass or less, and the alcohol content in the mixed feed is diluted to a concentration of 5% by mass or less. That is, in order to suppress the heat generation in the hydro-refining apparatus 30, it is required to adjust the mixing amount of the hydrogenated naphtha fraction to a range of 20% to 80% by volume with respect to the raw naphtha, and it is preferable that the lower limit be 30% by volume.

With regard to the second aspect of the present invention, as described above, since the naphtha fraction of the FT synthetic oil contains the most olefins and alcohols, it is required to adjust a cut point for the naphtha fraction supplied to the line 12 in the fractionator 10 in order to control the olefin concentration and the alcohol concentration of the naphtha fraction introduced from the line 12 into the apparatus 30. That is, if the FT synthetic oil contains a large amount of olefins and alcohols, the cut point for the naphtha fraction may be increased to reduce the olefin concentration in the naphtha fraction. In addition, as described above, such reduction of the olefin concentration by adjustment of the cut point may be combined in the first aspect of the present invention.

When the olefin concentration in the naphtha fraction is reduced by adjusting the cut point for the naphtha fraction, more specifically, the FT synthetic oil may be separated into at least one fraction containing hydrocarbons heavier than the naphtha fraction in the fractionator 10, such that the naphtha fraction (raw naphtha), which is fractionated in the fractionator 10, preferably contains 11% by mass or less of olefins and 6% by mass or less of alcohols, or more preferably contains 10% by mass or less of olefins and 5% by mass or less of alcohols. Then, the naphtha fraction is brought into contact with a hydrogenating catalyst in the hydro-refining apparatus 30 to hydrogenate the naphtha fraction whereby alcohols and olefins are converted to a paraffin component in order to obtain a hydrogenated naphtha fraction containing substantially only the paraffin component. In this way, unstable operation due to changes in the heat generation due to hydrogen addition to olefins in the hydro-refining apparatus 30 can be stabilized.

In operation of the fractionator 10 where higher yield of the middle fraction is required, the cut point for the naphtha fraction in the fractionator 10 is typically set to around 150° C. However, in the present invention, it is preferable that the cut point for the naphtha fraction be set to 160° C. to 190° C. in order to reduce the content of the olefins and alcohols in the naphtha fraction.

The kerosene and gas oil fraction of the middle fraction extracted from the line 13 may be subjected to a hydroisomerizing treatment using a known method, and may be subjected to distillation, and the resulting product can be used, for example, as a diesel fuel base stock.

Additionally, the wax fraction extracted from the line 14 may be subjected to a hydrocracking treatment using a known method, may be further subjected to distillation, and the resulting product can be used, for example, as a diesel fuel base stock.

Hereinafter, conditions for operating the naphtha reacting apparatus, etc. will be specifically described.

<Hydro-Refining of the Naphtha Fraction>

In the hydro-refining apparatus 30, hydro-refining of the naphtha fraction, which is fractionated in the fractionator 10, is performed. A known fixed-bed reacting tower may be used as the hydro-refining apparatus 30. In the present embodiment, in the reactor, a fixed-bed continuous flow reactor is filled with a required hydro-refining catalyst, and hydro-refining is performed by introducing hydrogen and the naphtha fraction obtained in the fractionator 10 into this reactor. The hydro-refined fraction is preferably delivered back to the hydro-refining apparatus 30 from the line 62, thereby recycling the hydro-refined fraction. The term "hydro-refining" used herein includes conversion of olefins into paraffins by hydrogen addition, and conversion of alcohols into paraffins by dehydroxylation.

Examples of the hydro-refining catalyst include a carrier of a solid acid onto which an active metal belonging to Group VIII in the periodic table is loaded.

Preferable examples of such a carrier includes a carrier containing a crystalline zeolite such as ultra-stable Y type (USY) zeolite, HY zeolite, mordenite, or β-zeolite one; and at least one solid acid selected from amorphous metal oxides having heat resistance, such as silica alumina, silica zirconia or alumina boria. Moreover, it is preferable that the carrier be a carrier containing USY zeolite; and at least one solid acid selected from silica alumina, alumina boria, and silica zirconia. Furthermore, a carrier containing USY zeolite and silica alumina is more preferable.

USY zeolite is a ultra-stabilized Y-type zeolite by way of a hydrothermal treatment and/or acid treatment, and fine pores within a range of 20 Å to 100 Å are formed in addition to a micro porous structure, which is called micropores of 20 Å or less originally included in Y-type zeolite. When USY zeolite is used for the carrier of the hydro-refining catalyst, its average particle diameter is not particularly limited. However, the average particle diameter thereof is preferably 1.0 μm or less, or more preferably 0.5 μm or less. In USY zeolite, a molar ratio of silica/alumina (i.e. molar ratio of silica to alumina; hereinafter referred to as "silica/alumina ratio") is preferably within a range of 10 to 200, more preferably within a range of 15 to 100, and the most preferably within a range of 20 to 60.

It is preferable that the carrier include 0.1% to 80% by mass of a crystalline zeolite and 0.1% to 60% by mass of a heat-resistant amorphous metal oxide.

A mixture including the above-mentioned solid acid and a binder may be subjected to shaping, and the shaped mixture may be calcined to produce the catalyst carrier. The ratio of the solid acid mixed therein is preferably within a range of 1% to 70% by mass, or more preferably within a range of 2% to 60% by mass with respect to the total amount of the carrier. If the carrier includes USY zeolite, the blend ratio of USY zeolite is preferably within a range of 0.1% to 10% by mass, or more preferably within a range of 0.5% to 5% by mass to the total amount of the carrier. If the carrier includes USY zeolite and alumina-boria, the blend ratio of USY zeolite to alumina-boria (USY zeolite/alumina-boria) is preferably within a range of 0.03 to 1 based on a mass ratio. If the carrier includes USY zeolite and silica alumina, the blend ratio of USY zeolite to silica alumina (USY zeolite/silica alumina) is preferably within a range of 0.03 to 1 based on a mass ratio.

The binder is not particularly limited. However, the binder is preferably alumina, silica, silica alumina, titania, or magnesia, and is more preferably alumina. The blend ratio of the binder is preferably within a range of 20% to 98% by mass, or more preferably within a range of 30% to 96% by mass based on the total amount of the carrier.

The calcination temperature of the mixture is preferably within a range of 400° C. to 550° C., more preferably within a range of 470° C. to 530° C., or particularly preferably within a range of 490° C. to 530° C.

Examples of the group VIII metal include cobalt, nickel, rhodium, palladium, iridium, platinum and the like. In particular, metal selected from nickel, palladium and platinum is preferably used singularly or in combination of two or more kinds.

These kinds of metal may be loaded on the above-mentioned carrier according to a common method such as impregnation, ion exchange or the like. The total amount of the loaded metal is not particularly limited. However, the amount of the loaded metal is preferably within a range of 0.1% to 3.0% by mass with respect to the carrier.

Hydro-refining of the naphtha fraction may be performed under the following reaction conditions. That is, the hydrogen partial pressure may be 0.5 MPa to 12 MPa, or preferably 1.0 MPa to 5.0 MPa. The liquid hourly space velocity (LHSV) may be 0.1 $h^{-1}$ to 10.0 $h^{-1}$, or preferably 0.3 $h^{-1}$ to 3.5 $h^{-1}$. The hydrogen/oil ratio is not particularly limited, but may be 50 NL/L to 1000 NL/L, or preferably 70 NL/L to 800 NL/L.

In the present description, "LHSV (liquid hourly space velocity)" refers to a volume flow rate of feed stock per capacity of a catalyst bed filled with a catalyst under standard conditions (at 25° C. and 101325 Pa), and the unit "$h^{-1}$" represents the reciprocal of hour. "NL" being the unit of hydrogen capacity in the hydrogen/oil ratio represents hydrogen capacity (L) under normal conditions (0° C. and 101325 Pa).

The reaction temperature for hydro-refining may be within a range of 180° C. to 400° C., preferably within a range of 200° C. to 370° C., more preferably within a range of 250° C. to 350° C., or particularly preferably within a range of 280° C. to 350° C. If the reaction temperature for hydro-refining exceeds 370° C., a side reaction such as decomposition may be promoted, thereby increasing a gas fraction, and the product may be colored, thereby limiting use of the naphtha fraction as a naphtha base stock. Therefore, such a temperature range is not preferred. If the reaction temperature is below 200° C., hydro-refining may be insufficient. Therefore, such a temperature range is not preferred.

EXAMPLES

Hereinafter, the present invention will be described in more detail with reference to Examples. However, the present invention is not limited to Examples.

<Preparation of Hydrogenating Catalyst>

(Catalyst A)

USY zeolite (molar ratio of silica/alumina: 37) having an average particle diameter of 1.1 μm silica alumina (molar ratio of silica/alumina: 14) and an alumina binder were mixed and kneaded at a weight ratio of 3:57:40, and the mixture was shaped into a cylindrical form having a diameter of about 1.6 mm and a length of about 4 mm. Then, this was calcined at 500° C. for one hour, thereby producing a carrier. The carrier was impregnated with a chloroplatinic acid aqueous solution to load platinum on the carrier. The impregnated carrier was dried at 120° C. for 3 hours, and then, calcined at 500° C. for one hour, thereby producing catalyst B. The amount of platinum loaded on the carrier was 0.8% by mass to the total amount of the carrier.

<Manufacture of Raw Naphtha>

(Fractionation of FT Synthetic Oil)

In the fractionator 10, oil produced by a FT synthesis method (i.e. FT synthetic oil) (the content of hydrocarbons having a boiling point of 150° C. or higher was 84% by mass, and the content of hydrocarbons having a boiling point of 360° C. or higher was 42% by mass, based on the total amount of the FT synthetic oil (corresponding to the sum of hydrocarbons having 5 or more carbon atoms)) was fractionated into a naphtha fraction having a boiling point of less than 160° C. which was extracted through the line 12; a first middle fraction having a boiling point of 160° C. to 350° C. which was extracted through the line 13; and a wax fraction as a bottom fraction which was extracted through the line 14.

Table 1 shows properties of the obtained naphtha fraction, the first middle fraction and the wax fraction.

In addition, the n-paraffin content (% by mass), the iso-paraffin content (% by mass), the alcohol content (% by mass) and the olefin content (% by mass) were calculated based on component analysis results of the components separated and quantitated by a gas chromatograph (SHIMADZU Corporation GC-2010) equipped with a nonpolar column (ultraalloy-1HT (30 m×0.25 mmϕ), and a FID (flame ionization detector); and using He as carrier gas, and a predetermined temperature program. The boiling range was determined in accordance with JIS K2254 "Petroleum products-Determination of distillation characteristics."

TABLE 1

| Raw naphtha (before hydrogenation) | | | |
|---|---|---|---|
| Properties | Raw naphtha | Middle fraction | Wax fraction |
| Boiling range (° C.) | Less than 160 | 160 to 350 | Higher than 350 |
| n-paraffin content (% by mass) | 82.5 | 95.0 | 98.0 |
| Iso-paraffin content (% by mass) | 0.0 | 0.0 | 0.0 |
| Alcohol content (% by mass) | 6.5 | 2.5 | 1.0 |
| Olefin content (% by mass) | 12.0 | 2.5 | 1.0 |

Example 1

(Hydro-Refining of Naphtha Fraction)

The hydro-refining apparatus 30, which is a fixed-bed flow reactor of FIG. 1, was filled with the hydrogenating catalyst A (150 ml), the above-obtained naphtha fraction (raw naphtha) was supplied thereto from the tower apex of the reactor 30 at a rate of 300 ml/h. Then, the naphtha fraction was hydrogenated in a hydrogen stream under the following reaction conditions.

That is, hydrogen was supplied thereto from the tower apex at a hydrogen/oil ratio of 340 NL/L to the naphtha fraction, and the reaction tower pressure was adjusted with a back pressure valve, such that the inlet pressure remained constant at 3.0 MPa (hydrogen partial pressure), thereby hydro-refining the naphtha fraction. At that time, the reaction temperature was 308° C.

The naphtha fraction hydrogenated in the hydro-refining apparatus 30 was delivered to the stabilizer 60 through the line 31, and further delivered to the tank 70 through the line 61, and the naphtha fraction was stored in the tank 70.

A portion of the above-obtained hydrogenated naphtha fraction was recycled from the line 62 to the line 12 so that the recycled hydrogenated naphtha fraction was mixed with the raw naphtha at a ratio of 33.3% by volume to the raw naphtha, and the mixed feed, whose properties are shown in Table 2, was treated under the same conditions as the above-described hydrogenation treatment, thereby producing synthetic naphtha. Table 2 shows properties of synthetic naphtha produced at the beginning of the operation of hydrogenation, and properties of synthetic naphtha produced after the 10,000 hours-operation.

In addition, the n-paraffin content (% by mass), the iso-paraffin content (% by mass), the alcohol content (% by mass), the olefin content (% by mass), and the boiling range were measured by the above-described analysis method.

Example 2

(Hydro-Refining of Naphtha Fraction)

The hydro-refining apparatus 30, which is a fixed-bed flow reactor of FIG. 1, was filled with the catalyst A (150 ml), the above-obtained naphtha fraction (raw naphtha) was supplied thereto from the tower apex of the reactor 30 at a rate of 300 ml/h, and the naphtha fraction was hydrogenated in a hydrogen stream under the following reaction conditions.

That is, hydrogen was supplied from the tower apex at a hydrogen/oil ratio of 340 NL/L to the naphtha fraction, and the reaction tower pressure was adjusted with a back pressure valve, such that the inlet pressure remained constant at 3.0 MPa (hydrogen partial pressure), thereby hydro-refining the naphtha fraction. At that time, the reaction temperature was 308° C.

The above-obtained hydrogenated naphtha fraction was mixed with the raw naphtha at a ratio of 50.0% by volume to obtain a mixed feed having the properties shown in Table 2, and the mixed feed was treated under the same conditions as the above-described hydrogenation treatment, thereby producing synthetic naphtha. Table 2 shows properties of synthetic naphtha produced at the beginning of the operation of hydrogenation, and properties of synthetic naphtha produced after the 10,000 hours-operation.

In addition, the content (mass %) of n-paraffin, the content (mass %) of iso-paraffin, the alcohol fraction (mass %), the olefin fraction (mass %) and the boiling point range were measured by the above-described analysis method.

Example 3

(Hydro-Refining of Naphtha Fraction)

The hydro-refining apparatus 30, which is a fixed-bed flow reactor of FIG. 1, was filled with the catalyst A (150 ml), the above-obtained naphtha fraction (raw naphtha) was supplied thereto from a tower apex of the reactor 30 at a rate of 300 ml/h, and the naphtha fraction was hydrogenated in a hydrogen stream under the following reaction conditions.

That is, hydrogen was supplied from the tower apex at a hydrogen/oil ratio of 340 NL/L to the naphtha fraction, the reaction tower pressure was adjusted with a back pressure valve where the inlet pressure remained constant at 3.0 MPa (hydrogen partial pressure), and the naphtha fraction was hydro-refined. At that time, the reaction temperature was 308° C.

The above-obtained hydrogenated naphtha fraction was mixed with the raw naphtha at a ratio of 66.7% by volume to the raw naphtha to obtain a mixed feed having properties shown in Table 2, and then, the mixed feed was treated under the same conditions as the above hydrogenation, thereby producing synthetic naphtha. Table 2 shows properties of synthetic naphtha produced at the beginning of the operation of hydrogenation, and properties of synthetic naphtha produced after the 10,000 hours-operation.

reaction tower pressure was adjusted with a back pressure valve such that the inlet pressure remained constant at 3.0 MPa (hydrogen partial pressure), and the naphtha fraction was hydro-refined to obtain synthetic naphtha. Table 2 shows properties of synthetic naphtha produced at the beginning of the operation of hydrogenation, and properties of synthetic naphtha produced after the 10,000 hours-operation.

In addition, the n-paraffin content (% by mass), the iso-paraffin content (% by mass), the alcohol content (% by mass), the olefin content (% by mass), and the boiling range were measured by the above-described analysis method.

TABLE 2

| Hydrogenated naphtha | | | | | |
|---|---|---|---|---|---|
| | | Example 1 | Example 2 | Example 3 | Comparative Example 1 |
| Reaction conditions | Reaction temperature (° C.) | 308 | 308 | 308 | 308 |
| | Hydrogen partial pressure (MPa) | 3.0 | 3.0 | 3.0 | 3.0 |
| | LHSV ($h^{-1}$) | 2.0 | 2.0 | 2.0 | 2.0 |
| | Catalyst | Catalyst A | Catalyst A | Catalyst A | Catalyst A |
| | Hydrogen/oil ratio (NL/L) | 340 | 340 | 340 | 340 |
| Amount of hydrogenated naphtha mixed to raw naphtha (% by volume) | | 33.3 | 50.0 | 66.7 | 0.0 |
| Mixed feed | Alcohol content (% by mass) | 4.5 | 3.3 | 2.2 | 6.5 |
| | Olefin content (% by mass) | 8.0 | 6.0 | 4.0 | 12.0 |
| Synthetic naphtha produced at the beginning of operation | Boiling range (° C.) | Less than 160 | Less than 160 | Less than 160 | Less than 160 |
| | n-paraffin content (% by mass) | 100.0 | 100.0 | 100.0 | 100.0 |
| | Iso-paraffin content (% by mass) | 0.0 | 0.0 | 0.0 | 0.0 |
| | Alcohol content (% by mass) | 0.0 | 0.0 | 0.0 | 0.0 |
| | Olefin content (% by mass) | 0.0 | 0.0 | 0.0 | 0.0 |
| Synthetic naphtha produced after 10,000 hours operation | Boiling range (° C.) | Less than 160 | Less than 160 | Less than 160 | Less than 160 |
| | n-paraffin content (% by mass) | 100.0 | 100.0 | 100.0 | 96.5 |
| | Iso-paraffin content (% by mass) | 0.0 | 0.0 | 0.0 | 0.0 |
| | Alcohol content (% by mass) | 0.0 | 0.0 | 0.0 | 1.5 |
| | Olefin content (% by mass) | 0.0 | 0.0 | 0.0 | 2.0 |
| Heat generation (increase of temperature) (relative comparison where the increase of temperature in Comparative Example 1 was considered 1) | | 0.67 | 0.49 | 0.33 | 1.0 |

In addition, the n-paraffin content (% by mass), the iso-paraffin content (% by mass), the alcohol content (% by mass), the olefin content (% by mass), and the boiling range were measured by the above-described analysis method.

Comparative Example 1

(Hydro-Refining of Naphtha Fraction)

The hydro-refining apparatus 30, which is a fixed-bed flow reactor of FIG. 1, was filled with the catalyst A (150 ml), the above-obtained naphtha fraction (raw naphtha) was supplied thereto from the tower apex of the reactor 30 at a rate of 300 ml/h, and the naphtha fraction was hydrogenated in a hydrogen stream under the following reaction conditions.

That is, hydrogen was supplied from the tower apex with a hydrogen/oil ratio of 340 NL/L to the naphtha fraction, the (Comparison of Heat Generation in Hydro-Refining Apparatus)

With respect to Examples 1 to 3 and Comparative Example 1, the reaction heat generated in each hydro-refining apparatus was calculated based on the standard entropy change of formation of hydrocarbon compounds before and after the reaction, and Examples were relatively compared with Comparative Example 1 where the heat generation in Comparative example 1 was considered as 1. Results of the comparison are shown in Table 2. Compared to Comparative Example 1 where the hydrogenated naphtha fraction was not recycled to raw naphtha, it was obvious that the manufacturing methods of Examples generated less heat, that is, suppressed heat generation due to the hydrogenation treatment.

In addition, in Comparative Example 1, conversion of olefins and alcohols into n-paraffins was obviously deteriorated based on properties of the synthetic naphtha after an 10,000 hours operation, and it was difficult to continuously conduct stable operation of the hydro-refining apparatus.

<Manufacture of Raw Naphtha>

Example 4

(Fractionation of FT Synthetic Oil)

In the fractionator 10, oil produced by a FT synthesis method (i.e. FT synthetic oil) (the content of hydrocarbons having a boiling point of 150° C. or higher was 84% by mass, and the content of hydrocarbons having a boiling point of 360° C. or higher was 42% by mass, based on the total amount of the FT synthetic oil (corresponding to the sum of hydrocarbons having 5 or more carbon atoms)) was fractionated into a naphtha fraction 1 having a boiling point of less than 170° C. which was extracted through the line 12; a middle fraction 1 having a boiling point of 170 to 350° C. which was extracted from the line 13; and a wax fraction 1 as a bottom fraction which was extracted from the line 14.

Table 3 shows properties of the obtained naphtha fraction 1, middle fraction 1 and wax fraction 1.

n addition, the n-paraffin content (% by mass), the iso-paraffin content (% by mass), the alcohol content (% by mass) and the olefin content (% by mass) were calculated based on component analysis results of the components separated therefrom and quantitated by a gas chromatograph (SHIMADZU Corporation GC-2010) equipped with a nonpolar column (ultraalloy-1HT (30 m×0.25 mmϕ), and a FID (flame ionization detector); and using He as carrier gas; and a predetermined temperature program. The boiling range was determined in accordance with JIS K2254 "Petroleum products-Determination of distillation characteristics."

TABLE 3

| | Raw naphtha (before hydrogenation) | | | | | | | | |
|---|---|---|---|---|---|---|---|---|---|
| | Fractions 1 | | | Fractions 2 | | | Fractions 3 | | |
| Properties | Raw naphtha 1 | Middle fraction 1 | Wax fraction 1 | Raw naphtha 2 | Middle fraction 2 | Wax fraction 2 | Raw naphtha 3 | Middle fraction 3 | Wax fraction 3 |
| Boiling range (° C.) | Less than 170 | 170 to 350 | Higher than 350 | Less than 190 | 190 to 350 | Higher than 350 | Less than 150 | 150 to 350 | Higher than 350 |
| n-paraffin content (% by mass) | 83.0 | 96.0 | 98.0 | 85.0 | 97.0 | 98.0 | 79.0 | 94.0 | 98.0 |
| Iso-paraffin content (% by mass) | 0.0 | 0.0 | 0.0 | 0.0 | 0.0 | 0.0 | 0.0 | 0.0 | 0.0 |
| Alcohol content (% by mass) | 6.0 | 2.0 | 1.0 | 5.0 | 1.5 | 1.0 | 7.0 | 3.0 | 1.0 |
| Olefin content (% by mass) | 11.0 | 2.0 | 1.0 | 10.0 | 1.5 | 1.0 | 14.0 | 3.0 | 1.0 |

(Hydro-Refining of Naphtha Fraction)

The hydro-refining apparatus 30, which is a fixed-bed flow reactor of FIG. 1, was filled with the hydrogenating catalyst A (150 ml), the above-obtained naphtha fraction 1 (raw naphtha) was supplied thereto from the tower apex of the reactor 30 at a rate of 300 ml/h, and the naphtha fraction 1 was hydrogenated in a hydrogen stream under the following reaction conditions.

That is, hydrogen was supplied from the tower apex with a hydrogen/oil ratio of 340 NL/L to the naphtha fraction 1, the reaction tower pressure was adjusted with a back pressure valve where the inlet pressure remained constant at 3.0 MPa (hydrogen partial pressure), and the naphtha fraction 1 was hydro-refined. At that time, the reaction temperature was 308° C.

The hydrogenated naphtha was delivered to the stabilizer 60 through the line 31, and further delivered to the tank 70 through the line 61.

Table 4 shows properties of synthetic naphtha produced at the beginning of the operation of hydrogenation of the naphtha fraction 1, and properties of synthetic naphtha produced after the 10,000 hours-operation.

In addition, the n-paraffin content (% by mass), the iso-paraffin content (% by mass), the alcohol content (% by mass), the olefin content (% by mass) and the boiling range were measured by the above-described analysis method.

Example 5

(Fractionation of FT Synthetic Oil)

In the fractionator 10, oil produced by a FT synthesis method (FT synthetic oil) (the content of hydrocarbons having a boiling point of 150° C. or higher was 84% by mass, and the content of hydrocarbons having a boiling point of 360° C. or higher was 42% by mass, based on the total amount of FT synthetic oil (corresponding to the sum of hydrocarbons having 5 or more carbon atoms)) was fractionated into a naphtha fraction 2 having a boiling point of less than 190° C., a middle fraction 2 having a boiling point of 190 to 350° C., and a wax fraction 2 as a bottom fraction.

Table 3 shows properties of the obtained naphtha fraction 2, middle fraction 2 and wax fraction 2.

In addition, the n-paraffin content (% by mass), the iso-paraffin content (% by mass), the alcohol content (% by mass), the olefin content (% by mass) and the boiling point range were measured by the above-described analysis method.

(Hydro-Refining of Naphtha Fraction)

The hydro-refining apparatus 30, which is a fixed-bed flow reactor, was filled with the catalyst A (150 ml), the above-obtained naphtha fraction 2 (raw naphtha) was supplied thereto from the tower apex of the reactor 30 at a rate of 300 ml/h, and the naphtha fraction 2 was hydrogenated in a hydrogen stream under the following reaction conditions.

That is, hydrogen was supplied from the tower apex with a hydrogen/oil ratio of 340 NL/L to the naphtha fraction 2, the reaction tower pressure was adjusted with a back pressure valve where inlet pressure remained constant at 3.0 MPa (hydrogen partial pressure), and the naphtha fraction 2 was hydro-refined. At that time, the reaction temperature was 308° C.

Table 4 shows properties of synthetic naphtha produced at the beginning of the operation of hydrogenation of the naphtha fraction 2, and properties of synthetic naphtha produced after the 10,000 hours-operation.

In addition, the n-paraffin content (% by mass), the isoparaffin content (% by mass), the alcohol content (% by mass), the olefin content (% by mass) and the boiling range were measured by the above-described analysis method.

Example 6

(Fractionation of FT Synthetic Oil)

FT synthesis oil was fractionated to obtain the naphtha fraction 2 in the same manner as Example 5.

(Hydro-Refining of Naphtha Fraction)

The hydro-refining apparatus 30, which is a fixed-bed flow reactor, was filled with the catalyst A (150 ml), the above-obtained naphtha fraction 2 (raw naphtha) was supplied thereto from the tower apex of the reactor 30 at a rate of 300 ml/h, and the naphtha fraction 2 was hydrogenated in a hydrogen stream under the following reaction conditions.

That is, hydrogen was supplied from the tower apex at a hydrogen/oil ratio of 340 NL/L to the naphtha fraction 2, the reaction tower pressure was adjusted with a back pressure valve where the inlet pressure remained constant at 3.0 MPa (hydrogen partial pressure), and the naphtha fraction 2 was hydro-refined. At that time, the reaction temperature was 308° C.

A portion of the above-obtained hydrogenated naphtha fraction was recycled from the line 62 to the line 12 so that the hydrogenated naphtha fraction was mixed with the raw naphtha at a ratio of 33.3% by volume to the raw naphtha, and the mixed feed, whose properties are shown in Table 4, was treated under the same conditions as the above-described hydrogenation treatment, thereby producing synthetic naphtha shown in Table 4.

Table 4 shows properties of synthetic naphtha produced at the beginning of the operation of hydrogenation of the naphtha fraction 2, and properties of synthetic naphtha produced after the 10,000 hours-operation.

In addition, the n-paraffin content (% by mass), the isoparaffin content (% by mass), the alcohol content (% by mass), the olefin content (% by mass) and the boiling range were measured by the above-described analysis method.

Comparative Example 2

(Fractionation of FT Synthetic Oil)

In the fractionator 10, oil produced by a FT synthesis method (FT synthetic oil) (the content of hydrocarbons having a boiling point of 150° C. or higher was 84% by mass, and the content of hydrocarbons having a boiling point of 360° C. or higher was 42% by mass, based on the total amount of FT synthetic oil (corresponding to the sum of hydrocarbons having 5 or more carbon atoms)) was fractionated into a naphtha fraction 3 having a boiling point of less than 150° C., a middle fraction 3 having a boiling point of 150 to 350° C., and a wax fraction 3 as a bottom fraction.

Table 3 shows properties of the obtained naphtha fraction 3, middle fraction 3 and wax fraction 3.

In addition, the n-paraffin content (% by mass), the isoparaffin content (% by mass), the alcohol content (% by mass), the olefin content (% by mass) and the boiling range were measured by the above-described analysis method.

(Hydro-Refining of Naphtha Fraction)

The hydro-refining apparatus 30, which is a fixed-bed flow reactor, was filled with the catalyst A (150 ml), the above-obtained naphtha fraction 3 (raw naphtha) was supplied thereto from the tower apex of the reactor 30 at a rate of 300 ml/h, and the naphtha fraction 3 was hydrogenated in a hydrogen stream under the following reaction conditions.

That is, hydrogen was supplied from the tower apex at a hydrogen/oil ratio of 340 NL/L to the naphtha fraction 3, the reaction tower pressure was adjusted with a back pressure valve where the inlet pressure remained constant at 3.0 MPa (hydrogen partial pressure), and the naphtha fraction 3 was hydro-refined. At that time, the reaction temperature was 308° C.

Table 4 shows properties of synthetic naphtha produced at the beginning of the operation of hydrogenation of the naphtha fraction 3, and properties of synthetic naphtha produced after the 10,000 hours-operation.

In addition, the n-paraffin content (% by mass), the isoparaffin content (% by mass), the alcohol content (% by mass), the olefin content (% by mass) and the boiling range were measured by the above-described analysis method.

TABLE 4

| | | Hydrogenated naphtha | | | |
|---|---|---|---|---|---|
| | | Example 4 | Example 5 | Example 6 | Comparative Example 2 |
| Reaction conditions | Raw naphtha | Raw naphtha 1 | Raw naphtha 2 | Raw naphtha 2 | Raw naphtha 3 |
| | Reaction temperature (° C.) | 308 | 308 | 308 | 308 |
| | Hydrogen partial pressure (MPa) | 3.0 | 3.0 | 3.0 | 3.0 |
| | LHSV ($h^{-1}$) | 2.0 | 2.0 | 2.0 | 2.0 |
| | Catalyst | Catalyst A | Catalyst A | Catalyst A | Catalyst A |
| | Hydrogen/oil ratio (NL/L) | 340 | 340 | 340 | 340 |
| Amount of hydrogenated naphtha mixed into raw naphtha (% by volume) | | — | — | 33.3 | — |
| Mixed feed | Alcohol content (% by mass) | — | — | 3.5 | — |
| | Olefin content (% by mass) | — | — | 6.5 | — |

TABLE 4-continued

| | | Hydrogenated naphtha | | | |
|---|---|---|---|---|---|
| | | Example 4 | Example 5 | Example 6 | Comparative Example 2 |
| Synthetic naphtha produced at the beginning of operation | Boiling range (° C.) | Less than 170 | Less than 190 | Less than 190 | Less than 150 |
| | n-paraffin content (% by mass) | 100.0 | 100.0 | 100.0 | 100.0 |
| | Iso-paraffin content (% by mass) | 0.0 | 0.0 | 0.0 | 0.0 |
| | Alcohol content (% by mass) | 0.0 | 0.0 | 0.0 | 0.0 |
| | Olefin content (% by mass) | 0.0 | 0.0 | 0.0 | 0.0 |
| Synthetic naphtha produced after 10,000 hours operation | Boiling range (° C.) | Less than 170 | Less than 190 | Less than 190 | Less than 150 |
| | n-paraffin content (% by mass) | 100.0 | 100.0 | 100.0 | 94.0 |
| | Iso-paraffin content (% by mass) | 0.0 | 0.0 | 0.0 | 0.0 |
| | Alcohol content (% by mass) | 0.0 | 0.0 | 0.0 | 3.0 |
| | Olefin content (% by mass) | 0.0 | 0.0 | 0.0 | 3.0 |
| Heat generation (increase of temperature) (relative comparison where the increase of temperature in Comparative Example 2 was considered 1) | | 0.71 | 0.60 | 0.40 | 1 |

(Comparison of Heat Generation in Hydro-Refining Apparatus)

With respect to Examples 4 to 6 and Comparative Example 2, reaction heat generated in each hydro-refining apparatus was calculated based on standard entropy change of formation of hydrocarbons compound before and after the reaction and was relatively compared with Comparative Example 2 where heat generated in Comparative Example 2 was considered as 1. Results of the comparison are shown in Table 4. Compared to Comparative Example 2 where the cut point adjustment was not conducted in the fractionator, it was obvious that the manufacturing methods of Examples 4 to 6 generated less heat, that is, suppressed the heat generation due to hydrogenation. In addition, in Comparative Example 2, conversion of olefins and alcohols into n-paraffins was obviously deteriorated based on properties of the synthetic naphtha produced after the 10,000 hours operation, and it was difficult to continuously conduct stable operation of the hydro-refining apparatus

Industrial Applicability

According to the present invention, in hydrogenation of naphtha fraction having much olefins and alcohols which is obtained from FT synthetic oil, synthetic naphtha can be manufactured without making operation of a hydro-refining apparatus unstable.

Accordingly, the present invention has high applicability in industries including GTL (Gas to Liquid) or petroleum refining.

The invention claimed is:

1. A method of manufacturing naphtha, comprising:

fractionating synthetic oil, which is obtained by Fisher-Tropsch synthesis, in a fractionator to separate the synthetic oil into a naphtha fraction as raw naphtha containing 10% by mass or more of an olefin and 5% by mass or more of an alcohol, and at least one fraction containing a hydrocarbon heavier than the naphtha fraction; and hydrogenating the naphtha fraction by bringing the naphtha fraction into contact with a hydrogenating catalyst in a hydro-refining apparatus to remove the alcohol and the olefin, thereby producing a hydrogenated naphtha fraction containing substantially only a paraffin component, wherein 20% to 80% by volume of the produced hydrogenated naphtha fraction with respect to the raw naphtha is recycled to the raw naphtha to hydrogenate the naphtha fraction whereby heat generation due to hydrogenation of the olefin and hydrogenation of the alcohol is suppressed.

2. The method of manufacturing naphtha according to claim 1, wherein the amounts of the olefin and the alcohol contained in the raw naphtha are measured in advance; and the ratio of the produced hydrogenated naphtha fraction recycled to the raw naphtha is adjusted where an olefin content in a mixed feed corresponding to the sum of the raw naphtha and the recycled hydrogenated naphtha fraction that are introduced into the hydro-refining apparatus is diluted to a concentration of 10% by mass or less, and an alcohol content in the mixed feed is diluted to a concentration of 5% by mass or less.

3. The method of manufacturing naphtha according to claim 1, further comprising adjusting a cut point in the fractionator to reduce the amounts of the olefin and the alcohol contained in the naphtha fraction whereby heat generation due to hydrogenation of the olefin and hydrogenation of the alcohol is suppressed in hydrogenating the naphtha fraction by bringing the naphtha fraction into contact with the hydrogenating catalyst in the hydro-refining apparatus to remove the alcohol and the olefin, thereby producing the hydrogenated naphtha fraction containing substantially only a paraffin component.

4. The method of manufacturing naphtha according to claim 3, wherein the cut point is adjusted where the amount of the olefin contained in the naphtha fraction reaches 11% by mass or less and the amount of the alcohol contained in the naphtha fraction reaches 6% by mass or less.

5. A method of manufacturing naphtha, comprising:

fractionating synthetic oil, which is obtained by Fisher-Tropsch synthesis, in a fractionator to separate the synthetic oil into a naphtha fraction and at least one fraction containing a hydrocarbon heavier than the naphtha fraction; and hydrogenating the naphtha fraction by bringing the naphtha fraction into contact with a hydrogenating catalyst in a hydro-refining apparatus to convert an alcohol and an olefin into a paraffin component, thereby producing a hydrogenated naphtha fraction containing substantially only the paraffin component, wherein the amounts of the olefin and the alcohol contained in the naphtha fraction are reduced by adjusting a cut point in the fractionator to suppress heat generation due to hydrogenation of the olefin and hydrogenation of the alcohol.

6. The method of manufacturing naphtha according to claim 5, wherein the cut point is adjusted where the amount of the olefin contained in the naphtha fraction reaches 11% by mass or less, and the amount of the alcohol contained in the naphtha fraction reaches 6% by mass or less.

* * * * *

UNITED STATES PATENT AND TRADEMARK OFFICE

CERTIFICATE OF CORRECTION

PATENT NO. : 8,367,883 B2
APPLICATION NO. : 12/733859
DATED : February 5, 2013
INVENTOR(S) : Yuichi Tanaka It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 474 days.

Signed and Sealed this
First Day of September, 2015

Michelle K. Lee

Michelle K. Lee
*Director of the United States Patent and Trademark Office*